US005352538A

United States Patent [19]

Takeda et al.

[11] Patent Number: 5,352,538

[45] Date of Patent: Oct. 4, 1994

[54] SURFACE HARDENED ALUMINUM PART AND METHOD OF PRODUCING SAME

[75] Inventors: Toshihide Takeda; Kaoru Adachi, both of Hirakata, Japan

[73] Assignee: Komatsu Ltd., Tokyo, Japan

[21] Appl. No.: 937,266

[22] Filed: Aug. 31, 1992

[51] Int. Cl.[5] ..... B22F 7/04

[52] U.S. Cl. ..... 428/553; 428/546; 428/551; 428/552; 428/564; 419/5; 419/8; 419/10; 419/13; 419/47

[58] Field of Search ..... 29/182.3; 92/212, 213; 123/48 C, 193.6, 270, 276, 669; 148/133, 206, 281, 421; 188/251 A; 428/539.6, 553, 569, 610, 613, 614; 505/1

[56] References Cited

U.S. PATENT DOCUMENTS

| | | | |
|---|---|---|---|
| 4,008,051 | 2/1977 | Cadle | 29/182.3 |
| 4,401,726 | 8/1983 | Gnanamuthu | 428/610 |
| 4,725,708 | 2/1988 | Kawasaki et al. | 219/121 LD |
| 4,902,359 | 2/1990 | Takeuchi | 148/133 |
| 4,942,804 | 7/1990 | Matsuura | 92/212 |
| 5,093,207 | 3/1992 | Hodes | 428/614 |

FOREIGN PATENT DOCUMENTS

| | | |
|---|---|---|
| 60-224790 | 11/1985 | Japan . |
| 61-166982 | 7/1986 | Japan . |
| 3201309 | 12/1989 | Japan . |
| 2-24637 | 5/1990 | Japan . |
| 4120280 | 7/1990 | Japan . |

*Primary Examiner*—Donald P. Walsh
*Assistant Examiner*—John N. Greaves
*Attorney, Agent, or Firm*—Millen, White, Zelano & Branigan

[57] ABSTRACT

A surface hardened aluminum part having excellent heat resistance and abrasion resistance obtained by forming, on the surface of an aluminum base material, an alloy layer that has a uniform composition and uniform hardness, being free from cracks. An aluminum alloy powder made of aluminum and metals each of which forms an intermetallic compound of high hardness with aluminum is prepared. This aluminum alloy powder is supplied onto the aluminum base material and the aluminum or aluminum alloy contained in the aluminum base material is alloyed with the aluminum alloy powder using a high-density energy heat source to form an alloy layer. The alloy layer thus formed has an intermetallic compound of high hardness uniformly distributed throughout the layer so that the hardness of the alloy layer is uniform and cracking is unlikely to occur.

20 Claims, 6 Drawing Sheets

SURFACE HARDENED ALUMINUM PART AND METHOD OF PRODUCING SAME

BACKGROUND OF THE INVENTION

1. Field of the Invention

The present invention relates to surface hardened aluminum parts in which a hardened layer possessing high resistance to abrasion and heat is formed on the surface of an aluminum base material made of aluminum or an aluminum alloy, and to a method of producing same.

2. Description of the Prior Art

Thanks to its small specific gravity (=2.7) and excellent corrosion resistance, aluminum has come into wide use for a variety of mechanical parts, e.g. in industrial robots, automobiles, and aircraft. However aluminum materials have markedly inferior abrasion resistance and heat resistance, compared with iron materials, and this could be a serious bar to employing aluminum parts in place of iron parts for the purpose of seeking light weight.

up to now, there have been proposed various techniques of forming a hardened layer (i.e., a hardened alloy layer), on the surface of an aluminum part to be provided in a position where high abrasion resistance and high heat resistance are required. One of those techniques that have been put to practical use is the so-called laser alloying method in which a powder of metal such as iron Fe, nickel Ni and cobalt Co is supplied onto an aluminum base material made of aluminum or an aluminum alloy and this powder metal is melted using a high-density energy heat source such as laser beams so as to be alloyed with the aluminum or aluminum alloy contained in the aluminum base material.

SUMMARY OF THE INVENTION

The hardening treatment carried out by the conventional laser alloying method, however, has several disadvantages: one is that since the aluminum or aluminum alloy of the aluminum base material and the metal to be alloyed therewith are being melted by laser radiation for a very short time of period, normally 0.5 second or less, the metal to be alloyed cannot be fully dispersed into the aluminum or aluminum alloy of the base material.

Another disadvantage is that most of the metals to be alloyed for forming an alloy layer have a higher specific gravity and a higher melting point than aluminum. For instance, nickel has a specific gravity of 7.9 and a melting point of 1453° C. while aluminum has, as has been mentioned, a specific gravity of 2.7 and a melting point of 660° C. These differences in terms of specific gravity and melting points cause the following problem: as nickel has high specific gravity and is difficult to melt because of its high melting point, it is likely to settle in the lower part of the molten pool, receiving laser beams, with the result that there is scarcely nickel remaining in the upper part of the molten pool. Therefore, the alloy layer obtained after cooling and solidification is not uniform in structure and has not satisfactory hardness because the proportion of nickel present in the upper part of the layer is small. Further, since the proportion of nickel contained in the lower part of the alloy layer is large, $Ni_3Al$ (Al is 86% by weight) is formed thereat. Although this $Ni_3Al$ has high hardness, it is so brittle that it can be a cause of cracking.

The thicker the alloy layer becomes, the more frequently the above-described problems inherent in the hardening treatment by the conventional laser alloying method arise. Therefore, there has been long awaited the development of a technique which enables formation of a homogeneous alloy layer that is unlikely to crack and possesses high hardness even when its thickness is 1 mm or more.

When the hardening treatment by the conventional laser alloying method is applied to a position such as a valve seat provided at the cylinder head of an engine, where movement relative to a mating member (i.e., a valve ) takes place, the wear of the mating member is extremely accelerated as the alloy layer has high hardness locally.

In order to overcome the foregoing problems, the invention aims to provide a surface hardened aluminum part and a method of producing same, the part having an alloy layer which is so formed on the surface of an aluminum base material that a hard intermetallic compound is uniformly formed throughout the layer, and that it offers excellent abrasion resistance and heat resistance without damaging its toughness.

After making tremendous research effort directed to solving the above problems, we have found that the following way is advantageous to accomplishing our objects: an alloy powder made of aluminum and metals to be preliminarily alloyed with the aluminum or aluminum alloy of an aluminum base material is prepared; the alloy powder is supplied onto the aluminum base material; and laser alloying is applied to the base material provided with the alloy powder. The present invention is based on this empirical knowledge.

Specifically, the surface hardened aluminum part according to the invention comprises an alloy layer formed on the surface of an aluminum base material made of aluminum or an aluminum alloy, the alloy layer containing an aluminum alloy powder of which particles are evenly dispersed therein and the aluminum alloy powder including at least a powder of one type of aluminum alloy made of aluminum and at least one metal selected from a group of metals each of which forms an intermetallic compound of high hardness with aluminum.

The method of producing the aforesaid surface hardened aluminum part comprises:

(a) a first process for providing an aluminum base material made of aluminum or an aluminum alloy with an aluminum alloy powder including at least a powder of one type of aluminum alloy made of aluminum and at least one metal selected from a group of metals each of which forms an intermetallic compound of high hardness with aluminum; and (b) a second process for forming an alloy layer by melting the aluminum alloy powder supplied onto the aluminum base material by the use of a high-density energy heat source so as to be alloyed with the aluminum or aluminum alloy contained in the aluminum base material.

With the above arrangement, the aluminum alloy powder that is preferably not more than 200 microns in particle size and has been supplied onto the aluminum base material is melted together with the aluminum or aluminum alloy of the surface of the base material by the high-density energy heat source, so that a molten pool is generated. In this molten pool, the molten aluminum alloy generated by melting the aluminum alloy powder is dispersed into the aluminum or aluminum alloy floating from the aluminum base material. In this case, the difference in specific gravity between the aluminum alloy of the aluminum alloy powder and the aluminum or aluminum alloy of the aluminum base material is comparatively small since both include aluminum as a component. Therefore, the sedimentation of the aluminum alloy of the aluminum alloy powder due to the difference in specific gravity is restrained so that the proportion of the aluminum alloy contained in the aluminum alloy powder present in the lower portion of the molten pool does not become too large.

This means that there does not occur formation of an intermetallic compound containing a large proportion of, e.g., $Ni_3Al$ which is unfavourable in a surface treatment for aluminum parts because it is hard but too brittle, and therefore troubles such as occurrence of cracking can be prevented. Further, a specified intermetallic compound can be formed in the alloy layer by specifying a composition of the aluminum alloy powder to be used so that it is possible to control the characteristics of the alloy layer to be formed on the surface of the aluminum base material.

Further, a metal which combines with aluminum to form a hard intermetallic compound is preliminarily alloyed with aluminum and then supplied onto the base material in the form of an aluminum alloy so that this metal has been already dispersed in aluminum when it is melted. Therefore, even if the metal is not fully dispersed into the aluminum or aluminum alloy of the aluminum base material, the proportion of the metal to aluminum can be easily made close to a desired proportion suited for generating an intermetallic compound. Accordingly, after the molten pool has been cooled and solidified, there is produced an alloy layer in which an intermetallic compound of high hardness is uniformly formed.

Metals capable of forming an intermetallic compound of high hardness with aluminum are employed as the above metal (metals) constituting the aluminum alloy powder. Among those metals are cobalt Co, chromium Cr, copper Cu, iron Fe, nickel Ni, manganese Mn, titanium Ti, tantalum Ta, and niobium Nb. One metal may be selected from the above group or a combination of two metals or more may be used. Those are eutectic or peritectic metals. Co, Cr, Cu, Fe, Ni, Mn and Ti have a melting point that is not lower than the melting point of Al and not higher than the boiling point of Al. Ta and Nb have a melting point that is not lower than the boiling point of Al. Li is one of the most preferable metals as further uniformity can be expected from the agitation caused by surface tension.

Ni is another preferable metal among those metals. When Ni is employed, 10 to 85% by weight of Ni with respect to Al content is preferably used to prepare a nickel aluminum alloy powder. The reason for this is that if Ni is 86% by weight or more, $Ni_3Al$ (Ni is 86% by weight) is likely to form in the alloy layer and if $Ni_3Al$ is formed, the objects of the invention cannot be accomplished because of its characteristics—hard and brittle. If Ni is less than 10% by weight, the hardness of the alloy layer becomes Hv 150 or less and thus satisfactory hardness cannot be obtained.

When using the nickel aluminum alloy powder of the above proportion, Ni is diluted by the aluminum or aluminum alloy contained in the aluminum base material and the resultant alloy layer formed on the surface of the base material has such a structure that 10 to 75% by weight of Ni is uniformly alloyed on the surface of the base material.

When aluminum is alloyed with at least one metal selected from metals each of which combines with aluminum to form an intermetallic compound of high hardness, it is preferable to add one element or a combination of two elements or more selected from the group of silicon Si, zinc Zn, lead Pb, bismuth Bi, vanadium V, lithium Li and tin Sn. Those elements are generally added to an aluminum alloy.

Preferably, the above first process and second process are not a so-called single weld pass that is performed only once, but a multiple weld pass that is repeatedly performed two times or more. This is because if the processes are performed only once, the metal to be alloyed with aluminum is more likely to settle in the lower part because of the difference in specific gravity, so that the upper part becomes dilute. On the other hand, when performing the processes repeatedly two times or more, the metal can be distributed forming vertical layers of deposits, whereby a uniform alloy layer structure having a desired composition and hardness can be achieved.

In order to perform such a multiple weld pass with a high-density energy heat source, the alloying method in which the supply of the aluminum alloy powder to desired positions and the radiation of high-density energy heat are carried out at the same time is more advantageous than the method in which the aluminum alloy powder is first supplied to desired positions of the aluminum base material and then high-density energy heat is radiated. By carrying out the supply of the aluminum alloy powder and the radiation of high-density energy heat at the same time, gasses present between the particles of the aluminum alloy powder are positively prevented from penetrating into the molten pool so that a homogeneous, high-quality deposit layer can be formed.

Such an aluminum alloy layer achieved by uniformly distributing aluminum alloy powder onto the surface of an aluminum base material is particularly suitable for being formed on the upper lip portion of a recess defined at the top of a piston for an internal combustion engine or the valve seat portion of the cylinder head of an internal combustion engine. It is also possible to form it on a valve seat to be inserted into a cylinder head.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and accompanying drawings which are given by way of illustration only, and thus are not limitative of present invention, and wherein.

DESCRIPTION OF THE PREFERRED EMBODIMENTS

Figure 1:
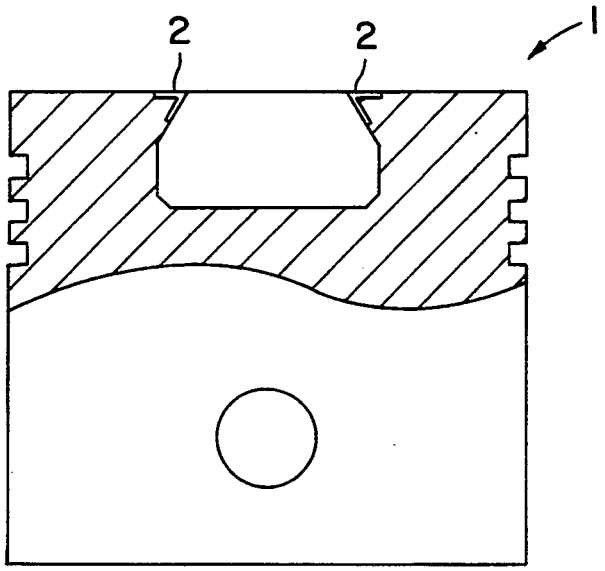
FIG. 1 is a cross section of an essential part of a piston for an internal combustion engine to which the invention is applied.

Referring now to the drawings, the surface hardened aluminum part and the method of producing same according to embodiments of the invention will be concretely described hereinbelow.

In the following embodiments, the invention is applied to a piston 1 for an internal combustion engine, the piston 1 having a recess defined at the centre of the top portion thereof as shown in FIG. 1. The piston 1 is made of an aluminum alloy and has an alloy layer 2 formed at the upper lip portion of the recess.

First Embodiment

Whilst the base material made of an aluminum alloy was being provided with nickel aluminum alloy powder of which composition was $NiAl_3$ (Ni was about 40% by weight), the laser alloying treatment was performed three times. The resultant alloy layer formed on the aluminum alloy base material had a uniform structure and no cracks. The average Ni content of the alloy layer structure was about 30% and the hardness was about Hv 300.

Second Embodiment

While the base material made of an aluminum alloy was being provided with nickel aluminum alloy powder of which composition was NiAl (Ni was about 68% by weight), the laser alloying treatment was performed three times. As a result, an alloy layer having a uniform structure and no cracks was obtained. The average Ni content of the alloy layer structure was about 38% and the hardness was Hv 300 to 500.

Figure 2:
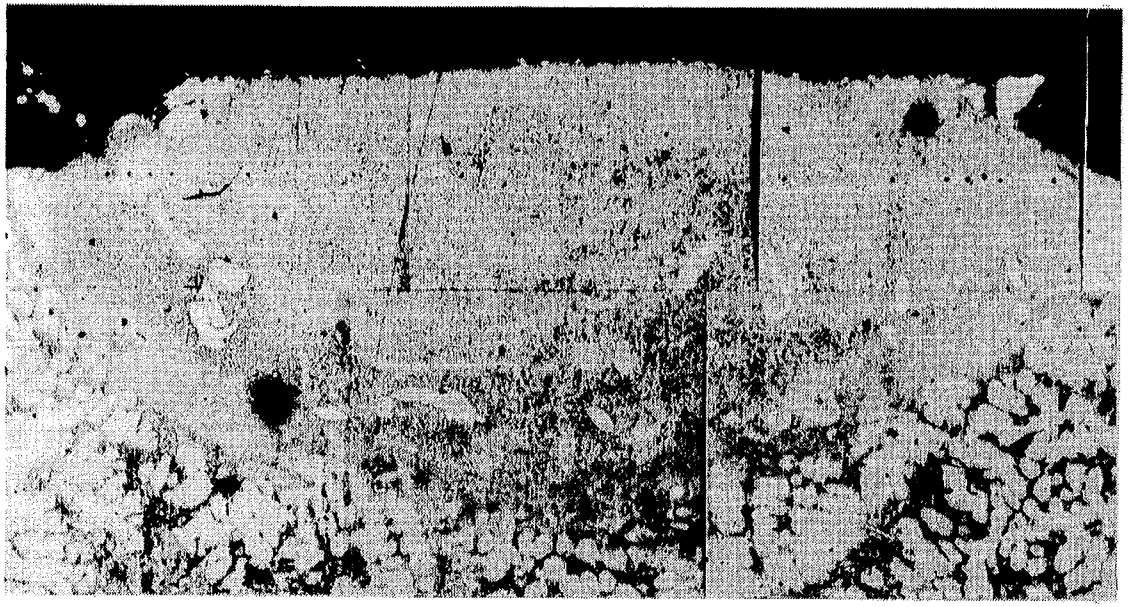
FIG. 2 is a microphotograph showing the metallic system of an alloy layer achieved in a second embodiment of the invention.
Figure 3:
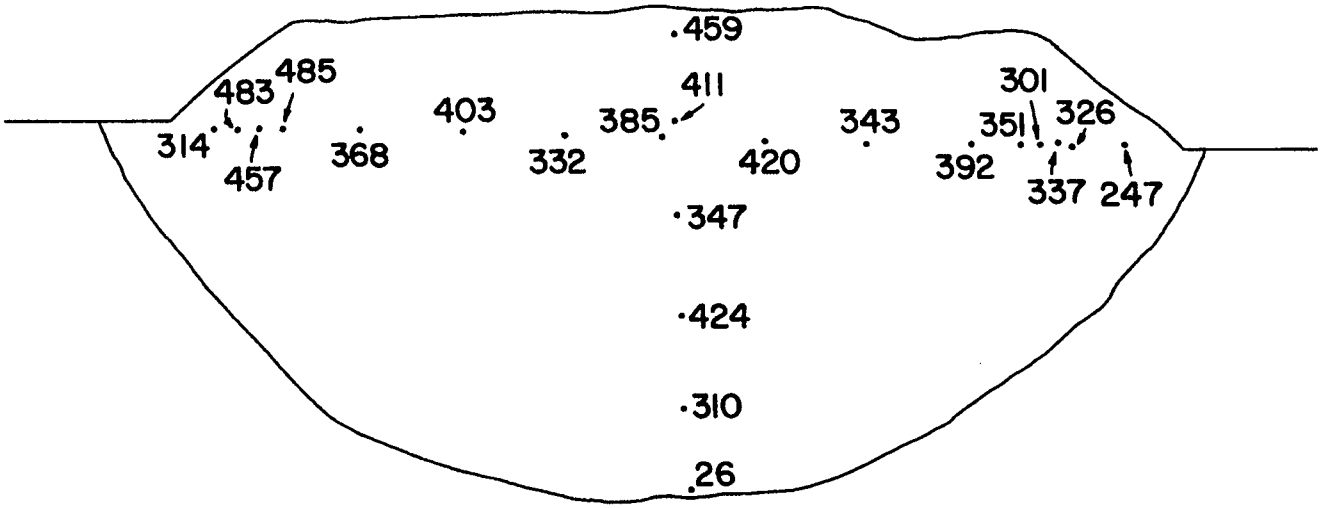
FIG. 3 is a distribution chart showing the hardness distribution of the alloy layer shown in FIG. 2.

FIG. 2 shows a microphotograph of the metallic system of the alloy layer obtained in the second embodiment, and FIG. 3 shows the hardness distribution (unit/Hv) of the alloy layer shown in FIG. 2. As apparent from FIGS. 2 and 3, a hard molten aluminum alloy in which the nickel aluminum alloy powder is melted is uniformly formed throughout the alloy layer obtained in this embodiment. It is also understood that the hardness of the alloy layer is uniform.

When the same treatment as that of the second embodiment was applied to the valve seat portion of the cylinder head of an internal combustion engine, an alloy layer having a hardness of Hv 332 to 420 was formed on the valve seat.

Third Embodiment

While the base material made of an aluminum alloy was being provided with nickel aluminum alloy powder of which composition was NiAl (Ni was about 68% by weight), the laser alloying treatment was performed five times. As a result, an alloy layer having a uniform structure and no cracks was obtained. The average Ni content of the alloy layer structure was about 50% and the hardness was Hv 600 to 700.

Comparative Example

While the base material made of an aluminum alloy was being provided with pure iron powder, the laser alloying treatment was performed once. In the resultant alloy layer, there were found cracks and deposits of iron which had been separated.

Figure 4:
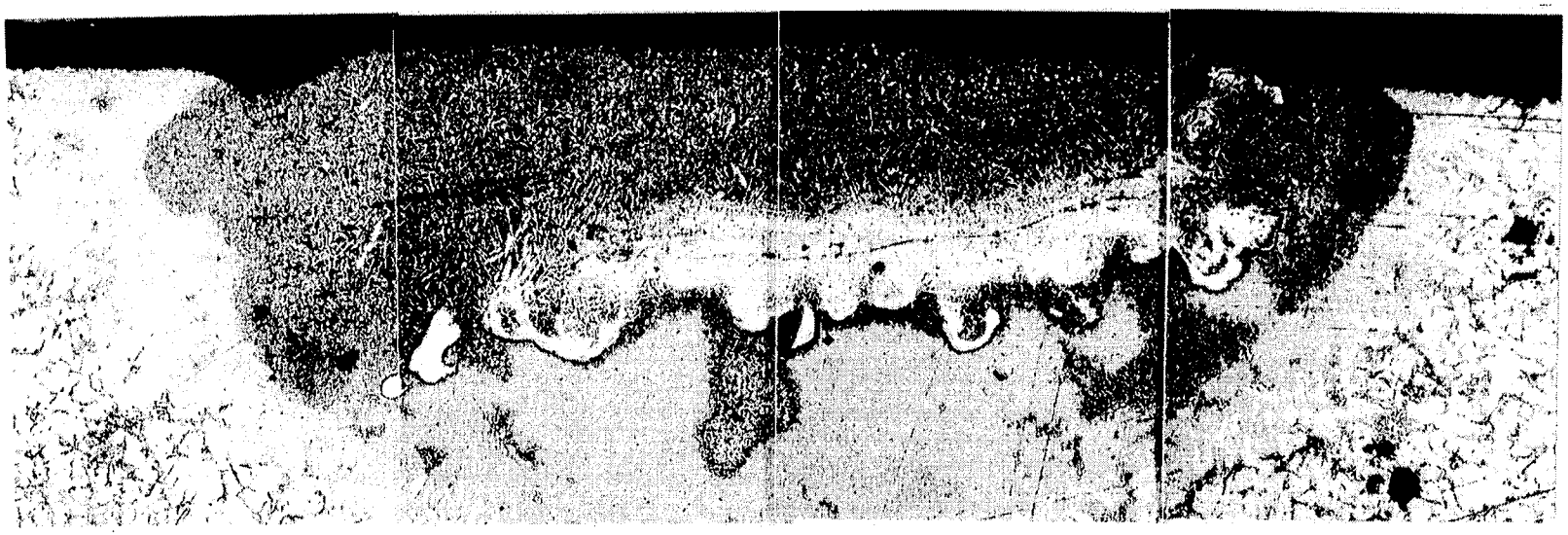
FIG. 4 is a microphotograph showing the metallic system of an alloy layer achieved in a comparative example.
Figure 5:
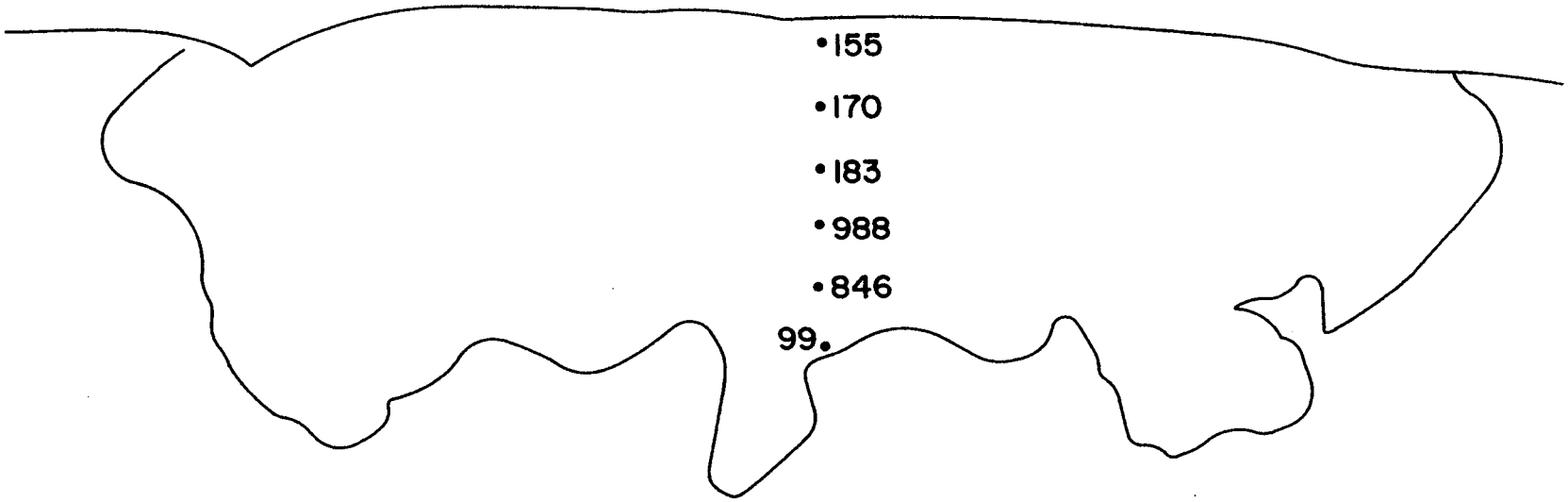
FIG. 5 is a distribution chart showing the hardness distribution of the alloy layer shown in FIG. 4.

FIG. 4 shows a microphotograph of the metallic system of the alloy layer obtained in this comparative example, and FIG. 5 shows the hardness distribution (unit/Hv) of the alloy layer shown in FIG. 4. It is apparent from FIGS. 4 and 5 that the alloy layer obtained in the comparative example has a non-uniform structure, and unsatisfactory hardness at the upper part thereof.

Figure 6:
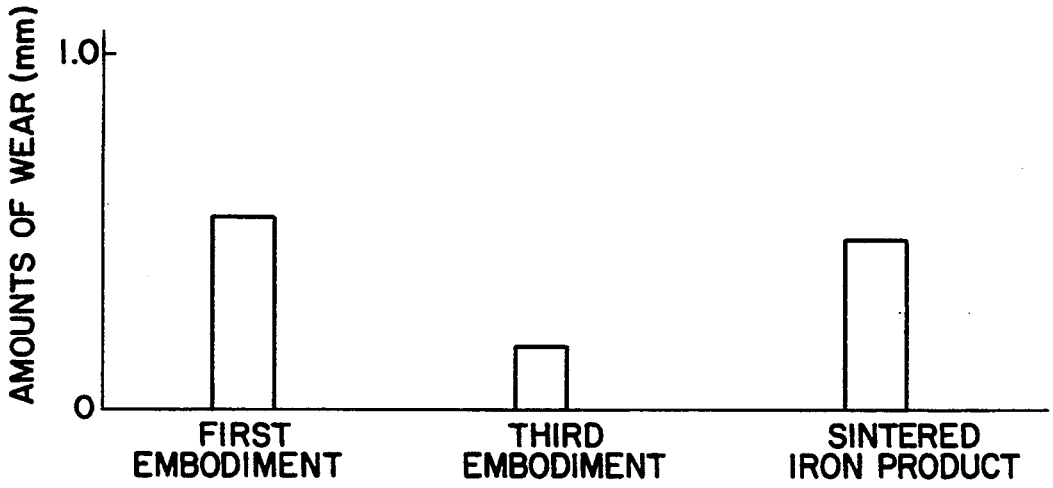
FIG. 6 is a graph showing the results of dry sliding tests conducted on alloy layers achieved in a first embodiment and third embodiment of the invention and on a sintered iron product.
Figure 7:
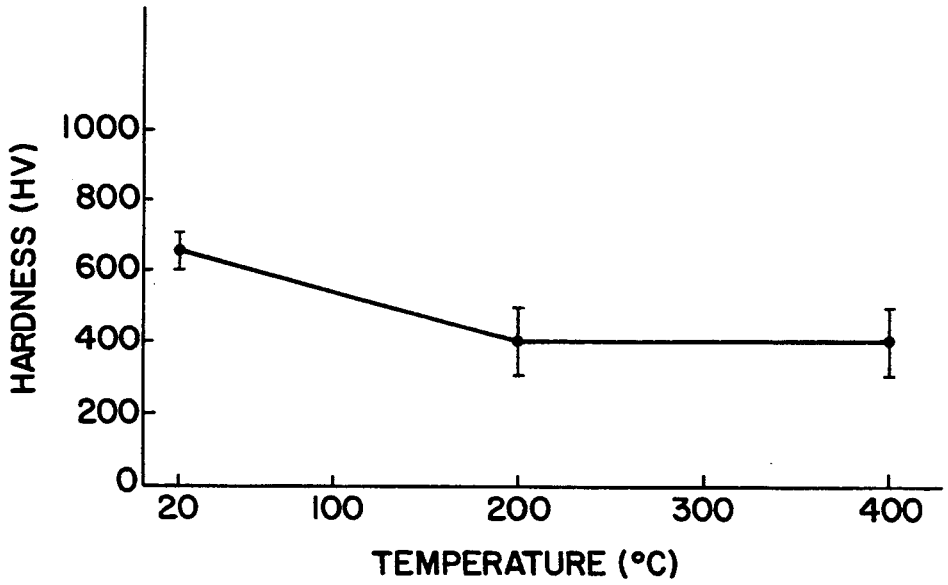
FIG. 7 is a graph of the hardness of the alloy layer achieved in the third embodiment, the hardness being measured at high temperatures.

Next, dry sliding tests were conducted on the alloy layers obtained in the first and third embodiments to measure their abrasion resistance. These tests were carried out in accordance with the normal experiment method. As the mating member used for sliding, high carbon chrome bearing steel SUJ2 with a hardness of $H_RC$ 58 to 64 which had undergone hardening and tempering was used. FIG. 6 shows the results of these tests. As understood from FIG. 6, the alloy layers obtained in the first and third embodiments have the substantially same abrasion resistance as that of a sintered iron product.

when the hardness (Hv) of the alloy layer of the third embodiment was measured at high temperatures, the alloy layer proved to have enough hardness at 400° C. as understood from FIG. 7.

Using cobalt Co, copper Cu, chromium Cr, iron Fe, manganese Mn, titanium Ti and tantalum Ta as the metal used for producing the aluminum alloy powder, the same laser alloying treatment as performed in the above embodiments was carried out. The results are shown in Table 1. In Table 1, Sample Nos. 1 to 7 are the cases in which an alloy powder made of one of the above metals and aluminum was used. Sample No. 8 is the case in which an alloy powder made of copper, nickel and aluminum was used. Sample Nos. 9 to 11 are comparative examples in which a powder made of a simple substance of nickel was used.

TABLE 1

| Sample | Composition of powder metal to be supplied (wt %) | | | | | | | | | Number of repeated processes | Hardness | | |
|---|---|---|---|---|---|---|---|---|---|---|---|---|---|
| No. | Co | Cu | Cr | Fe | Mn | Ti | Ta | Ni | Al | (times) | (Hv) | Crack | Note |
| 1 | 70 | | | | | | | | 30 | 5 | 450–600 | No | *1 |
| 2 | | 50 | | | | | | | 50 | 3 | 300–450 | No | *1 |
| 3 | | | 50 | | | | | | 50 | 5 | 500–600 | No | *1 |
| 4 | | | | 70 | | | | | 30 | 5 | 400–500 | No | *1 |

TABLE 1-continued

| Sample No. | Composition of powder metal to be supplied (wt %) Co | Cu | Cr | Fe | Mn | Ti | Ta | Ni | Al | Number of repeated processes (times) | Hardness (Hv) | Crack | Note |
|---|---|---|---|---|---|---|---|---|---|---|---|---|---|
| 5 | | | | | 50 | | | | 50 | 4 | 300–400 | No | *1 |
| 6 | | | | | | 70 | | | 30 | 5 | 500–600 | No | *1 |
| 7 | | | | | | | 50 | | 50 | 5 | 400–500 | No | *1 |
| 8 | | 35 | | | | | | 15 | 50 | 5 | 300–400 | No | *1 |
| 9 | | | | | | | | 100 | | 1 | 200–800 | Yes | *2 |
| 10 | | | | | | | | 100 | | 2 | 300–850 | Yes | *2 |
| 11 | | | | | | | | 100 | | 5 | 400–1000 | Yes | *2 |

*1 . . . present invention
*2 . . . comparative examples

As understood from Table 1, the alloy layers formed by the method according to the invention proved to have uniform hardness and no cracks. On the other hand, the laser alloying treatment by the use of the powder made of a simple substance of nickel failed in obtaining a uniform alloy layer structure and in preventing the occurrence of cracking even when the treatment was repeatedly performed multiple times.

In the above embodiments, it is preferable to mix the aluminum alloy powder with a ceramic powder such as titanium carbide TiC. The ceramic powder is coated with a metal (e.g., Co) which combines with aluminum to form an intermetallic compound of high hardness, or alternatively coated with an alloy of the above metal (e.g., Co) and aluminum. The use of such a mixture enables formation of an alloy layer having a hardness higher than that of an alloy layer formed when the ceramic powder is evenly dispersed. More specifically, the particles of a coated powder made of a ceramic powder such as Ti coated with a metal such as Co have much smaller specific gravity than the particles of the powder of a simple substance of Co when those particles have the same size so that the coated powder is restrained from settling in the lower part of the alloy layer, receiving high viscosity resistance in the molten aluminum. Therefore, there occurs no difference between the hardness of the upper part and that of the lower part in the alloy layer. Moreover, since an intermetallic compound of the coated metal and the aluminum or aluminum alloy is generated in the alloy layer, the strength of the alloy layer is increased. Further, since the surface area of the coated metal is larger than that of the powder of a simple substance, the area of contact with the aluminum or aluminum alloy is increased, and the intermetallic compound is more uniformly generated, resulting in more uniform strength distribution.

In the above embodiments, it is preferable to form, e.g., by coating, a flux layer of potassium fluoride (KF) group on the surface of the aluminum base material prior to the supply of the aluminum alloy powder. Alternatively, a flux such as potassium fluoride KF may be previously added to the aluminum alloy powder. The use of a flux allows an oxide film formed on the molten pool to be chemically melted or removed by reduction. This improves the absorption rate of high-density energy and facilitates the ingress of the aluminum alloy powder into the molten pool. As the high-density energy heat source for alloying the aluminum alloy power with the aluminum or aluminum alloy of the aluminum base material in the laser alloying treatment, electron beams, plasma transferred arc (P.T.A), tungsten inert gas arc (T.I.G), metal inert gas arc (M.I.G) or other equivalent heat sources may be used in place of laser beams.

Although an aluminum alloy powder made of one type of alloy of aluminum and one metal or a combination of two or more metals selected from a group of metals each of which forms a hard intermetallic compound with aluminum is employed in the above embodiments (Sample Nos. 1 to 7, and Sample No. 8), it is also possible to use an aluminum alloy powder made of two types of aluminum alloys produced by alloying aluminum with one metal Or a combination of two or more metals selected from the group of metals each of which forms a hard intermetallic compound with aluminum.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A surface hardened aluminum part comprising an alloy layer formed on the surface of an aluminum base material made of aluminum or an aluminum alloy, said alloy layer formed from an aluminum alloy powder of which particles are evenly dispersed therein and said aluminum alloy powder including at least a powder of one type of aluminum alloy made of aluminum and at least one metal selected from a group of metals each of which forms an intermetallic compound of high hardness with aluminum.

2. The surface hardened aluminum part as claimed in claim 1, wherein said group of metals each of which forms an intermetallic compound of high hardness with aluminum consists of cobalt, chromium, copper, iron, nickel, manganese, titanium, tantalum and niobium.

3. A surface hardened aluminum part comprising an alloy layer formed on the surface of an aluminum base material made of aluminum or an aluminum alloy, said alloy layer formed from a nickel aluminum alloy powder of which particles are evenly dispersed therein and said nickel aluminum alloy powder containing 10 to 75% by weight of nickel with respect to aluminum.

4. The surface hardened aluminum part as claimed in claim 1, wherein said alloy layer is formed at the upper lip portion of a recess defined at the top of a piston for an internal combustion engine.

5. The surface hardened aluminum part as claimed claim 1, wherein said alloy layer is formed on the valve seat portion of the cylinder head of an internal combustion engine.

6. A method for producing a surface hardened aluminum part comprising:

(a) first, providing an aluminum base material made of aluminum or an aluminum alloy with an aluminum alloy powder including at least a powder of one type of aluminum alloy made of aluminum and at least one metal selected from a group of metals each of which forms an intermetallic compound of high hardness with aluminum; and (b) second, forming an alloy layer by melting the aluminum alloy powder supplied onto the aluminum base material by use of a high-density energy heat source so as to be alloyed with the aluminum or aluminum alloy contained in the aluminum base material.

7. The method for producing a surface hardened aluminum part as claimed in claim 6, wherein said group of metals each of which forms an intermetallic compound of high hardness with aluminum consists of cobalt, chromium, copper, iron, nickel, manganese, titanium, tantalum and niobium.

8. The method for producing a surface hardened aluminum part as claimed in claim 7, wherein when producing the aluminum alloy with aluminum and at least one metal selected from the group of metals each of which forms an intermetallic compound of high hardness with aluminum, at least one element selected from the group consisting of silicon, zinc, lead, bismuth, vanadium, lithium and tin is added to said aluminum alloy.

9. The method for producing surface hardened aluminum part as claimed in claim 7, wherein said aluminum alloy powder includes a ceramic powder coated with at least one metal selected from the group of metals each of which forms an intermetallic compound with aluminum or an aluminum alloy made of aluminum and said metal.

10. A method for producing a surface hardened aluminum part comprising:

(a) first, providing an aluminum base material made of aluminum or an aluminum alloy with an aluminum alloy powder including a nickel aluminum alloy containing 10 to 85% by weight of nickel with respect to aluminum; and (b) second, forming an alloy layer by melting the aluminum alloy powder supplied onto the aluminum base material by use of a high-density energy heat source so as to be alloyed with the aluminum or aluminum alloy contained in the aluminum base material.

11. The method for producing a surface hardened aluminum part as claimed in claim 10, wherein when producing the nickel aluminum alloy with nickel and aluminum, at least one element selected from the group consisting of silicon, zinc, lead, bismuth, vanadium, lithium and tin is added to the nickel aluminum alloy.

12. The method for producing a surface hardened aluminum part as claimed in claim 10, wherein said aluminum alloy powder includes a ceramic powder coated with nickel or an alloy of nickel and aluminum.

13. The method for producing a surface hardened aluminum part as claimed in claim 6, wherein the first and second steps are repeatedly performed a plurality of times.

14. The method for producing a surface hardened aluminum part as claimed in claim 6, wherein said high-density energy heat source is a laser beam, electron beam, plasma transferred arc, tungsten inert gas arc, or metal inert gas arc.

15. A surface hardened aluminum part according to claim 1, wherein said at least one metal is nickel.

16. A surface hardened aluminum part according to claim 2, wherein said aluminum alloy powder further comprises at least one element from the group consisting of silicon, zinc, lead, bismuth, vanadium, lithium and tin.

17. A surface hardened aluminum part according to claim 15, wherein said aluminum alloy powder further comprises at least one element from the group consisting of silicon, zinc, lead, bismuth, vanadium, lithium and tin.

18. A surface hardened aluminum part according to claim 16, wherein said at least one element is lithium.

19. A surface hardened aluminum part according to claim 17, wherein said at least one element is lithium.

20. A surface hardened aluminum part according to claim 2, wherein said aluminum alloy powder comprises titanium carbide coated with said at least one metal.

* * * * *